US008307489B1

(12) United States Patent
Adame

(10) Patent No.: US 8,307,489 B1
(45) Date of Patent: Nov. 13, 2012

(54) TOWEL ASSEMBLY

(76) Inventor: Ronald Adame, Wichita, KS (US)

( * ) Notice: Subject to any disclaimer, the term of this patent is extended or adjusted under 35 U.S.C. 154(b) by 403 days.

(21) Appl. No.: 12/508,796

(22) Filed: Jul. 24, 2009

(51) Int. Cl.
*A46B 1/00* (2006.01)

(52) U.S. Cl. ..... 15/105; 15/209.1

(58) Field of Classification Search ..... 15/208–210.1, 15/105
See application file for complete search history.

(56) References Cited

U.S. PATENT DOCUMENTS

| | | | | |
|---|---|---|---|---|
| 2,754,532 | A | 7/1956 | Canehl | |
| 4,771,502 | A * | 9/1988 | Trimble | 15/209.1 |
| 5,147,703 | A | 9/1992 | Provost et al. | |
| D339,496 | S | 9/1993 | Corcoran | |
| 5,286,019 | A * | 2/1994 | Watabe | 473/282 |
| D347,542 | S | 6/1994 | Sheppard, Jr. | |
| D377,131 | S * | 1/1997 | Davis | D6/608 |
| 5,761,761 | A | 6/1998 | An | |
| 5,771,523 | A | 6/1998 | Rudolph | |
| 6,076,224 | A | 6/2000 | Pacifico | |
| 6,115,872 | A | 9/2000 | Welsh | |
| 7,152,279 | B2 | 12/2006 | Elliott | |
| 7,219,388 | B2 * | 5/2007 | Hale | 15/209.1 |
| 7,302,728 | B2 | 12/2007 | Kunz | |
| 2007/0226934 | A1 | 10/2007 | Bohannon et al. | |

FOREIGN PATENT DOCUMENTS

| | | | |
|---|---|---|---|
| GB | 2324465 | A * | 10/1998 |
| WO | WO98/00537 | | 2/1998 |
| WO | WO98/04176 | | 2/1998 |
| WO | WO2007/115234 | | 10/2007 |

* cited by examiner

*Primary Examiner* — Laura C Guidotti
(74) *Attorney, Agent, or Firm* — Kenneth H. Jack; Davis & Jack, L.L.C.

(57) ABSTRACT

A towel assembly for suspension from a golf push cart handle, the towel assembly including an absorbent fabric sheet having an upper end, a lower end, a lateral side, an oppositely lateral side, a rearward surface, and a forward surface; a vertical fold extending the fabric sheet's lateral side forwardly and oppositely laterally; a horizontal fold extending the fabric sheet's upper end forwardly and downwardly; snap fasteners connected operatively to the fabric sheet, the snap fasteners being adapted for, upon positioning the golf push cart handle beneath the horizontal fold, alternatively enveloping the golf push cart handle for the towel suspension, and releasing the golf push cart handle; and embroidered logo indicia positioned upon the fabric sheet's rearward surface.

8 Claims, 6 Drawing Sheets

TOWEL ASSEMBLY

FIELD OF THE INVENTION

This invention relates both to sports hand towels and to logo displaying banners. More particularly, this invention relates to golfer's hand towels and to logo indicia displays associated with golf bags and golf bag carrying wheeled push carts.

BACKGROUND OF THE INVENTION

Golfer's hand towels are known to include various forms of hooks, loops, and fasteners which serve the function of hanging or suspending the hand towel from a golf bag or from a wheeled golf push cart which carries a golf bag. A common problem or disadvantage of such known hand towel assemblies may be experienced upon suspension of the hand towel from a golf bag or golf bag push cart. During windy weather, such hand towels undesirably flap and wave in a dissheveled, rumpled, and unsightly fashion, and thereby undesirably obscure any corporate or sport team logo indicia displayed upon the hand towel.

Golf bags carried upon golf push carts are also known to be customized in order to cause a flat outer and lateral surface of the golf bag to display various corporate or sports team logo indicia. While such displays are unaffected by windy weather, utilizing golf bags for such customized logo display is undesirably permanent and non-interchangeable, and is undesirably expensive.

The instant towel assembly solves or ameliorates both the problems of golf towels discussed above, and the problems of logo display upon golf bags discussed above by providing a specially configured golf towel which is adapted to neatly hang as a display banner from a golf push cart handle.

BRIEF SUMMARY OF THE INVENTION

A major structural component of the instant inventive towel assembly for suspension from a golf push cart handle comprises an absorbent fabric sheet. Preferably, the absorbent fabric sheet comprises terry cloth and has an upper end, a lower end, a lateral side, an oppositely lateral side, a rearward surface, and has a forward surface.

A further structural component of the instant inventive towel assembly comprises at least a first substantially straight and vertically extending fold. Preferably, such at least first fold is configured to extend the fabric sheet's lateral side forwardly and oppositely laterally. Where only such at least first fold is incorporated, its resultant extension preferably half folds the sheet.

A further structural component of the instant inventive towel assembly comprises a substantially straight and horizontally extending fold. Preferably, the horizontal fold extends the fabric sheet's upper end forwardly and downwardly to define a tubular golf push cart handle receiving space. Such forward and downward extension is aesthetically preferred because the horizontal seam is shrouded. Suitably, though less desirably, the horizontal fold may alternatively extend the fabric sheet's upper end rearwardly and downwardly to similarly define the tubular handle receiving space.

A further structural component of the instant towel assembly comprises releasable attaching means which are connective operatively to the upper end of the fabric sheet. Preferably, the releasable attaching means are adapted for, upon positioning of a golf push cart handle within the upper tubular space defined by the horizontal fold, enveloping or encasing the golf push cart handle for suspension of the towel assembly therefrom. In a preferred embodiment of the instant invention, the releasable attaching means comprises a plurality of snap fasteners. Suitably, the releasable attaching means may alternatively comprise "velour crochet" type loop pad and flexible hook pad combinations, button and button hole combination, hook and eye combinations, or magnetic fasteners.

A further component of the instant invention comprises logo indicia. Preferably, the logo indicia comprises a corporate service mark, a corporate trade mark, a corporate trade name, a sport team name, or a sport team symbol. Preferably, the logo indicia is fitted and sized for convenient display upon the absorbent fabric sheet.

A further structural component of the instant inventive towel assembly comprises applique' means which are preferably adapted for interconnecting the logo indicia and the fabric sheet. The applique' means preferably positions the logo indicia for rearward display upon the fabric sheet's rearward surface. The applique means preferably further positions the logo indicia oppositely laterally from the fabric sheet's vertically extending fold.

In the preferred embodiment, a pair of vertical folds are provided which result in the half folding of the sheet via lateral and oppositely lateral quarter folding. Where such paired vertical folds are provided, the applique' means preferably positions the logo indicia between the vertical folds.

Provided that the fabric sheet has the preferred paired vertical folds which substantially laterally and oppositely laterally quarter fold the fabric sheet, a vertical or downwardly extending fabric tube (in addition to the upper horizontally extending push cart handle receiving tube) is advantageously formed. Such second downwardly extending tube beneficially holds the fabric sheet in a neat and substantially rectangular banner configuration during windy conditions and while the hand towel is not in use for hand or golf ball drying.

Preferably, the applique' means comprises an image application selected from the group consisting of embroidered images, printed images, and interwoven images, and thermal image transfers.

In use of the instant inventive towel assembly, a golfer may initially open the releasable attaching means and may position the towel assembly with respect to a horizontally extending golf push cart handle so that the handle immediately underlies the site of the towel assembly's horizontal fold. Thereafter, the golfer may manipulate the assembly's releasable attaching means to cause the upper end of the absorbent fabric sheet to envelope or encase in a tubular fashion the golf push cart handle. Upon engagement of the releasable attaching means, the towel assembly securely hangs downwardly from the golf push cart handle while the rectangular arrangement of the sheet imposed by the first and second vertical folds neatly holds the sheet in a display banner configuration. During windy conditions, the lateral and oppositely lateral quarter folded configuration of the absorbent fabric sheet, and the resultant vertically extending fabric tube tends to hold or quickly return the towel assembly to such banner displaying configuration. Thus, while the instant inventive assembly is not in use for hand or golf ball drying, the assembly advantageously rearwardly displays the logo indicia in the manner of a banner.

A further preferred structure of the instant inventive towel assembly comprises an umbrella mounting and slide stopping aperture which extends through the upper end of the absorbent fabric sheet. Preferably, such aperture is centrally located and opens at the site of the horizontal fold and within a wall of the assembly's upper push cart handle receiving tube. Where the push cart handle presents, as is common, a threaded golf umbrella receiving socket, such aperture may be aligned therewith so that, upon such releasable attachment of the assembly as described above, and upon threaded mounting of golf umbrella through the aperture and into such socket, the golf umbrella's handle advantageously functions as a slide stop. During windy weather, such umbrella handle slide stop prevents the assembly from slidably moving laterally along the golf push cart handle.

Accordingly, it is an object of the instant invention to provide a towel assembly which provides and incorporates structures and features as discussed and described above, and which arranges those structures and features with respect to each other for the performance of beneficial functions, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
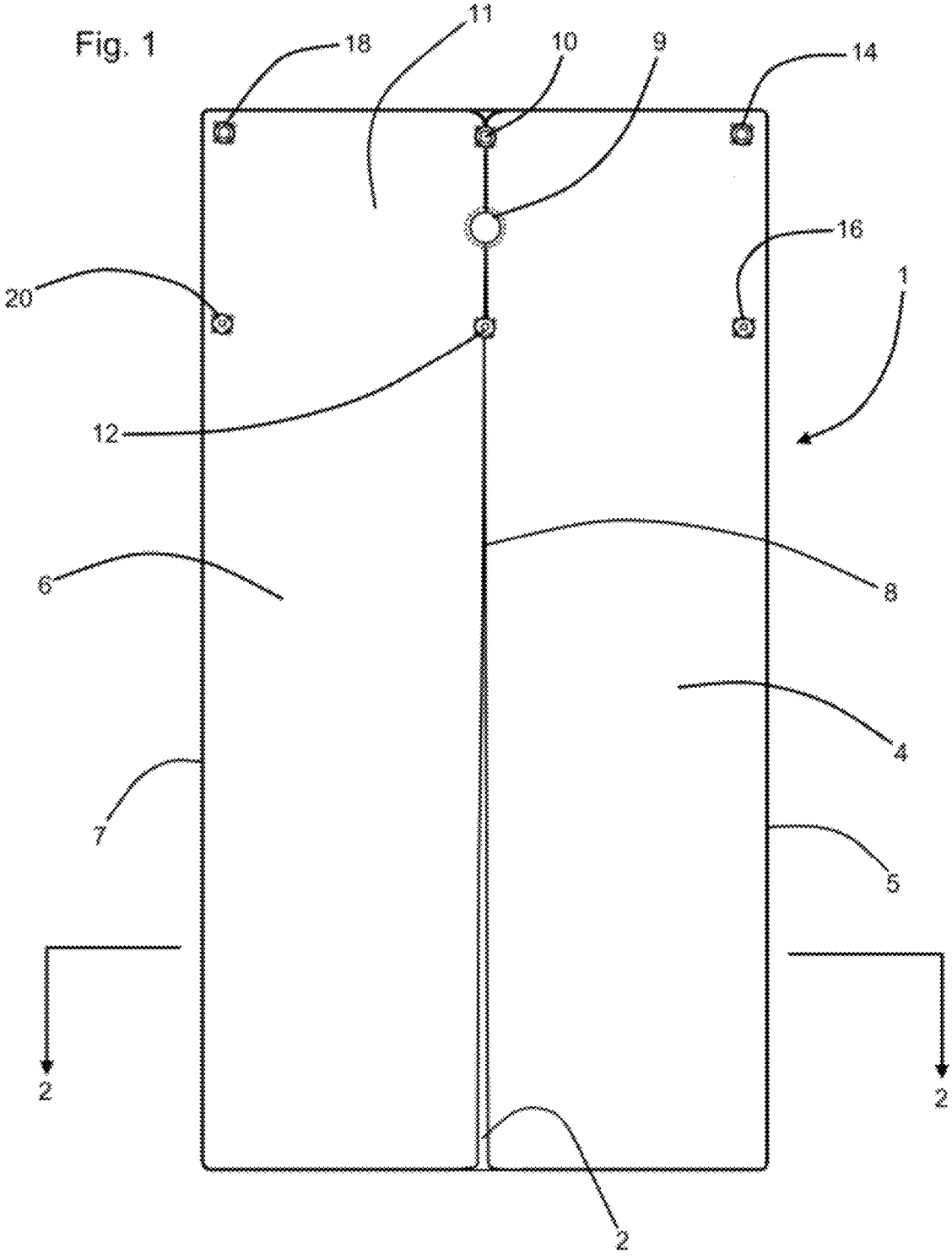
FIG. 1 is a front side view of the instant inventive towel assembly for suspension from a golf push cart handle.

Referring simultaneously to FIG. 1, a preferred embodiment of the instant inventive towel assembly is referred to generally by Reference Arrow 1. The towel assembly 1 comprises a preferably absorbent terry cloth sheet having, referring further to FIG. 2, a front surface 2, a rear surface 3, and having upper and lower ends oriented in correspondence with the view of FIG. 1. Said sheet preferably has lateral and oppositely lateral folds 5 and 7 which respectively extend quarter fold sections of the sheet 4 and 6 forwardly and respectively oppositely laterally and laterally. Such preferred quarter folding of the sheet creates a seam 8, and forms a vertically extending and substantially flattened tube having tube bore 48.

Figure 6:
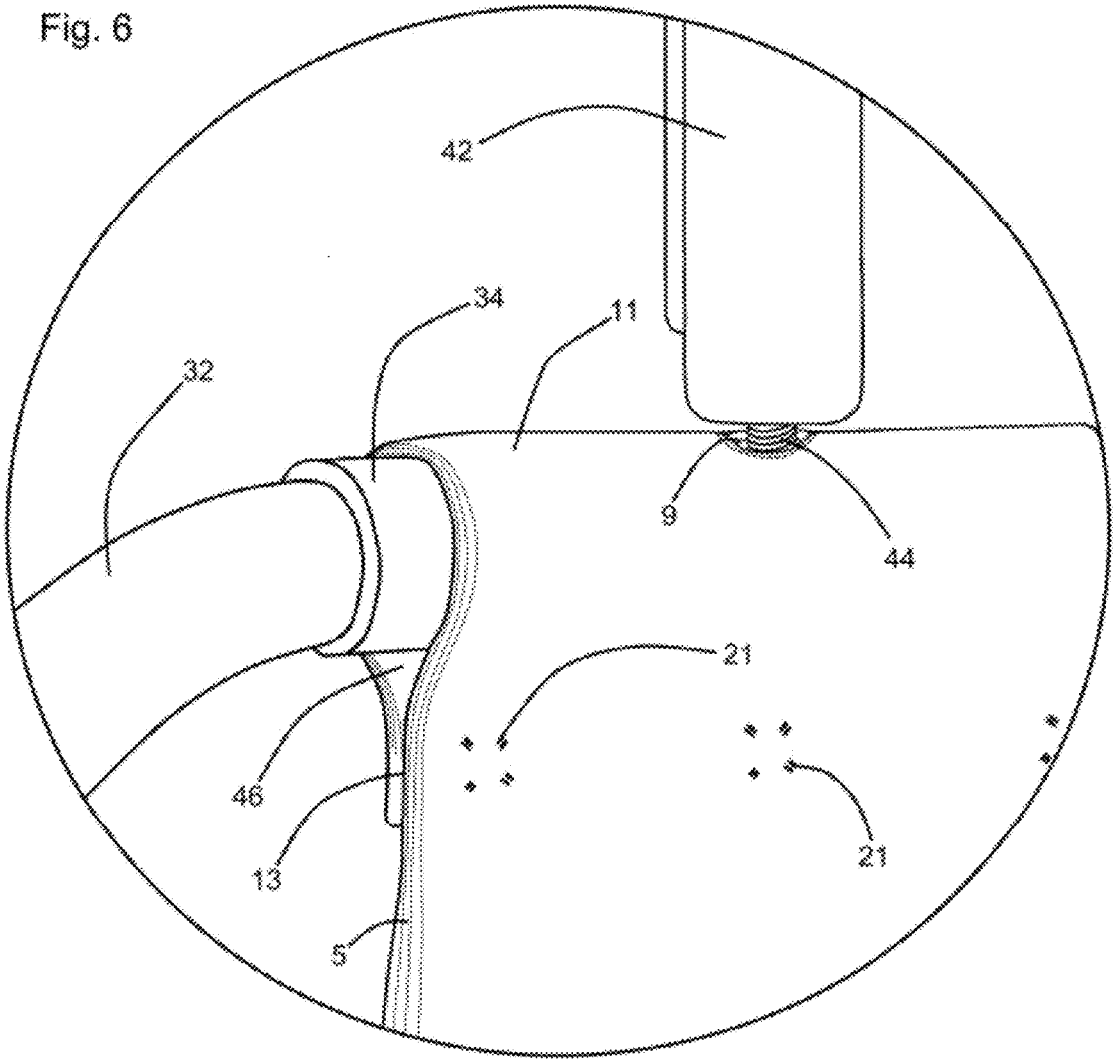
FIG. 6 is a magnified partial view as indicated in FIG. 5.

Referring to FIG. 6, an upper horizontally extending fold 11 preferably extends the upper end of the fabric sheet forwardly and downwardly to form a tubular cart handle receiving space 46, such fold being fitted and positioned for receiving a golf push cart handle 32,34.

Referring further to FIG. 1, upon receipt of the handle, the extreme upper end of the sheet preferably meets the upper ends of the quarter folded sections 4 and 6 of the sheet to form a horizontal seam 13. Such seam is preferably secured by snap fastener combinations 10 and 12, 14 and 16, and 18 and 20. Such fasteners are preferably sewn to the sheet by stitching 21 to advantageously serve as releasable attaching means to allow the enveloping tube 46 to alternatively capture the handle 32,34 and disengage for releasing the handle. The sheet's downwardly extending tubular portion 48 is, as depicted, preferably formed wholly with the horizontally extending tubular structure 46, and the stitching 21 preferably dually functions for fastener attachment and for holding the downward extension in such tubular configuration.

Figure 5:
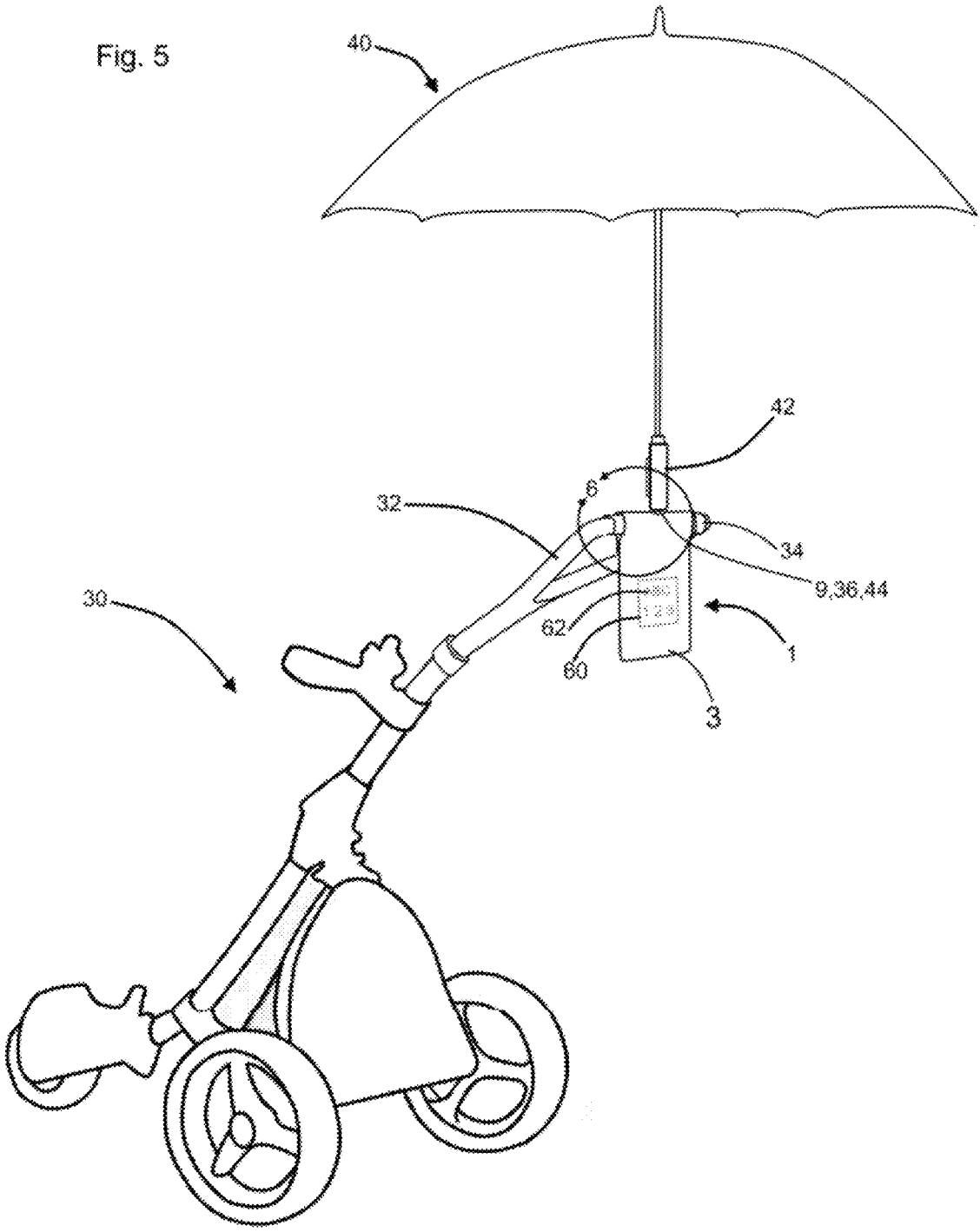
FIG. 5 redepicts FIG. 4, the view of FIG. 5 showing the inventive towel assembly mounted for use upon the golf push cart's handle.

Referring to FIG. 5, logo indicia 60,62 shown in dashed lines is representative of various corporate service marks, corporate trade marks, corporate trade names, sport team names, and sport team symbols which are known to be displayed upon the sides of golf bags. As a substitute for such golf bag display, such logo indicia are preferably attached to the rearward surface 3 of the fabric sheet by means of embroidery, direct printing, thermal image transfer, or interweaving of images.

Figure 3:
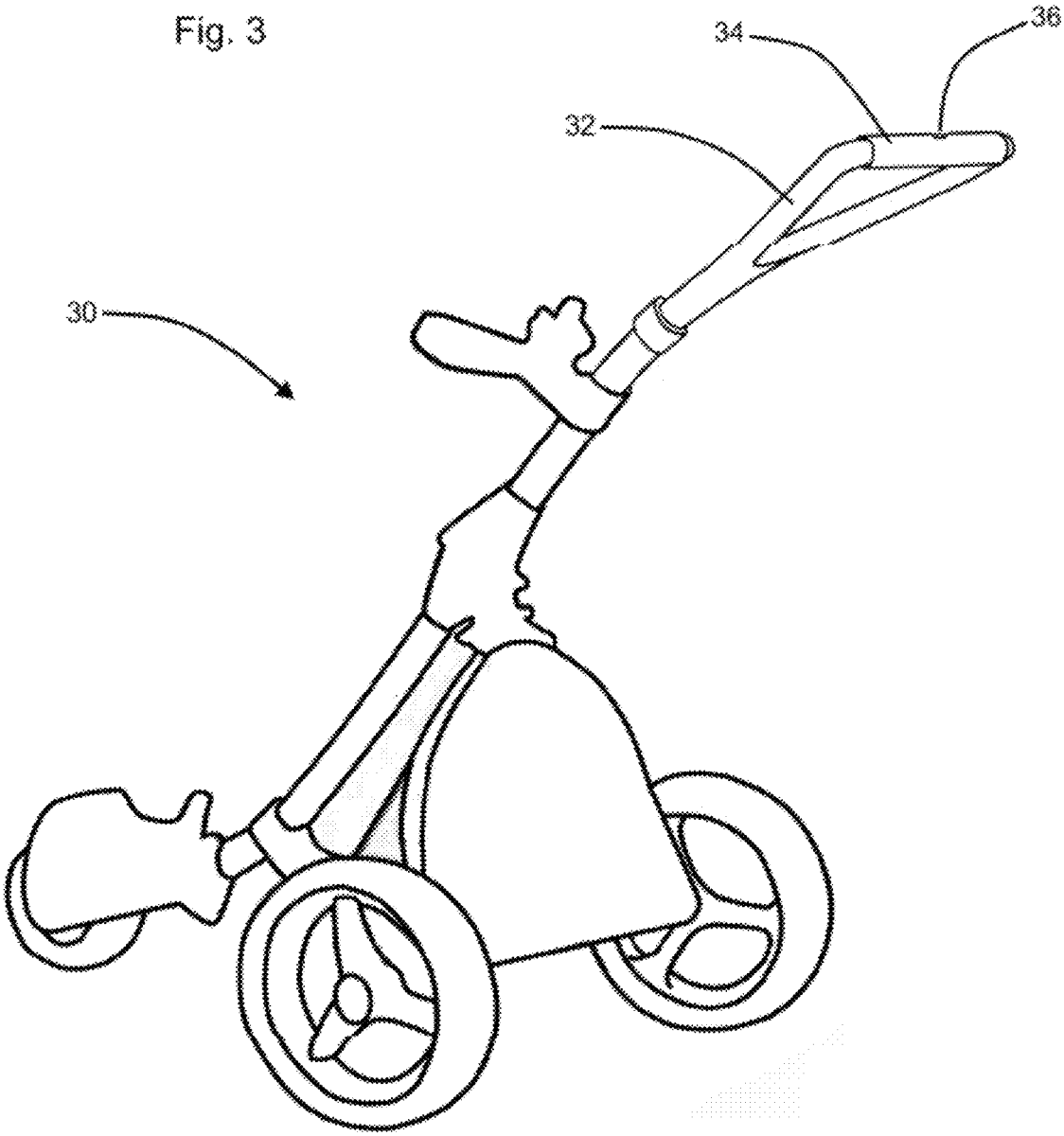
FIG. 3 depicts an exemplary golf push cart upon which the towel assembly may be utilized.
Figure 4:
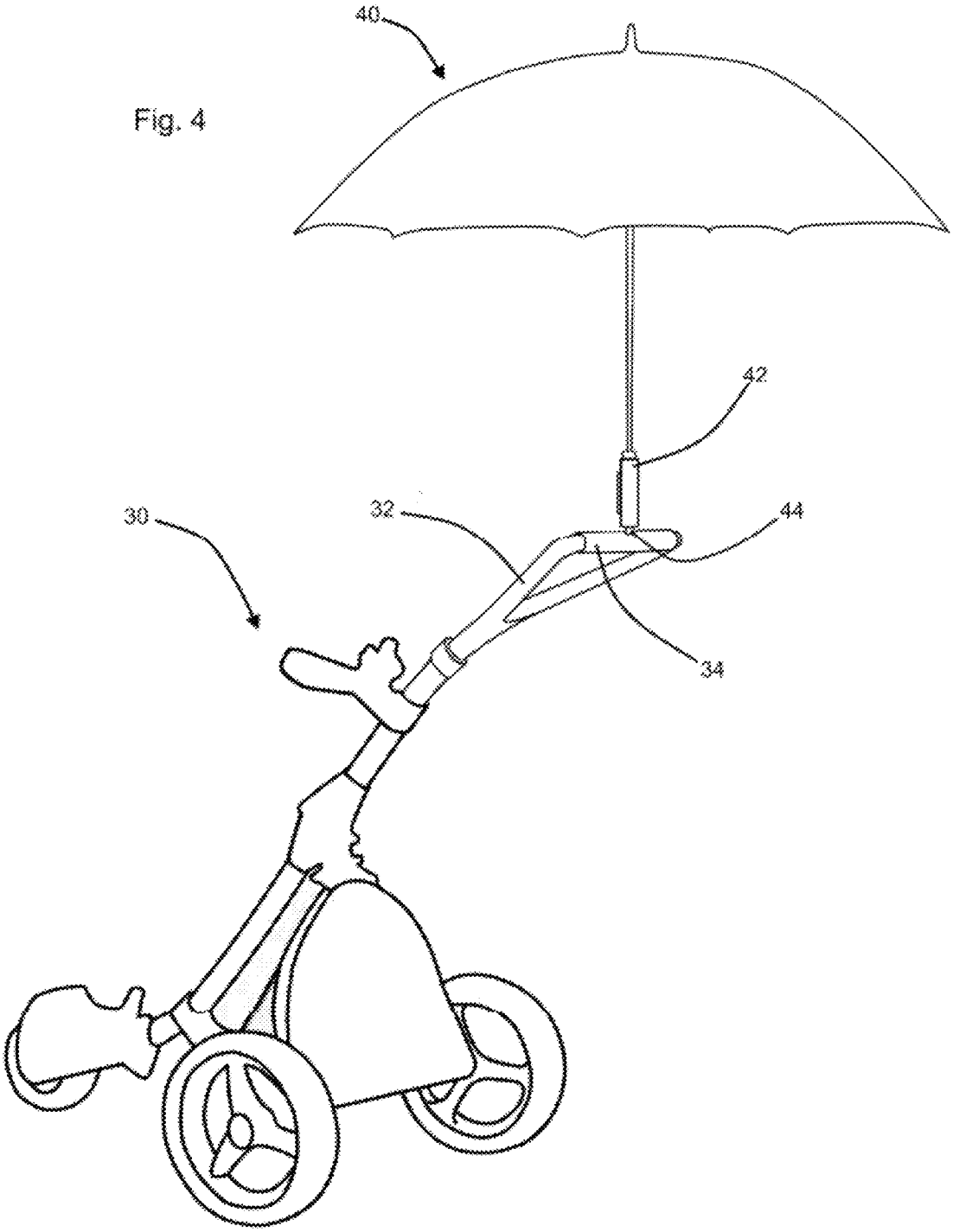
FIG. 4 redepicts FIG. 3, the view of FIG. 4 additionally showing a golf umbrella mounted upon the golf push cart's handle.

Referring to FIG. 3, an exemplary golf push cart is referred to generally by Reference Arrow 30, such cart having the handle structure 32 and 34. Such cart handles conventionally include an upwardly opening helically threaded socket 36 which, referring further simultaneously to FIGS. 5 and 6, facilitates mounting of a golf umbrella 40. The handle 42 of such golf umbrella 40 commonly presents a downwardly extending helically threaded lug 44 which is fitted for threaded engagement with socket 36. Referring further to FIG. 1, in order to facilitate mounting of such umbrella 40 upon the cart handle 32,34, an umbrella receiving aperture 9 preferably extends through the upper end of the sheet at the site of the horizontal fold 11. In addition to its facilitation of handle mounting of the umbrella 40, the aperture 9 advantageously utilizes the umbrella's helically threaded lug 44 as a slide stop which during windy conditions. Mechanical interference between the edge of the aperture 9 and the lug 44 prevents the inventive towel assembly from being blown laterally away from its desired central alignment upon the handle 32,34.

Figure 2:
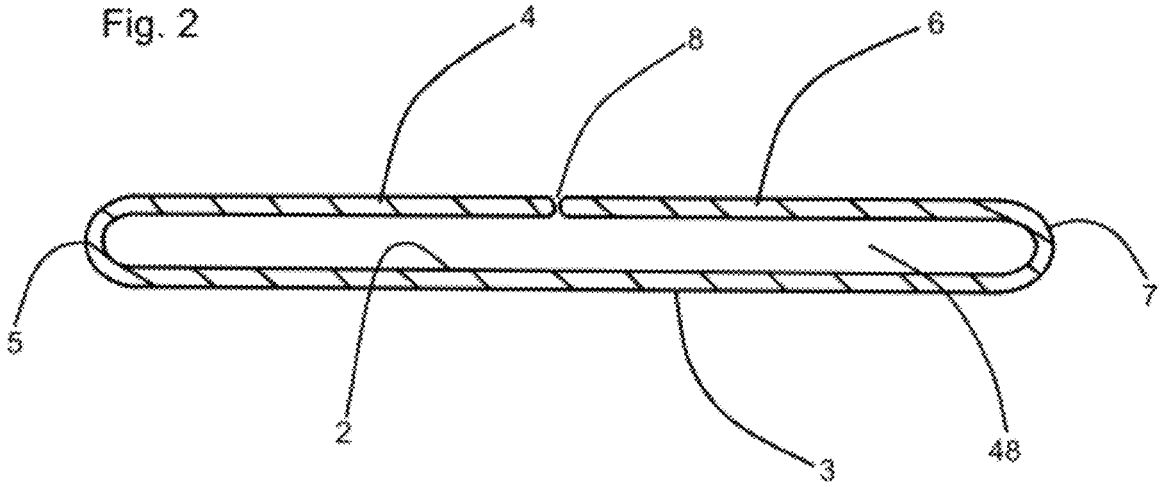
FIG. 2 is a sectional view as indicated in FIG. 1.

In use of the instant inventive assembly, referring in particular to FIG. 1, the towel assembly 1 may be initially configured with its snap and snap fastener combinations 10 and 12, 14 and 16, and 18 and 20 opened. Referring further simultaneously to FIG. 3, a user/golfer may then drape the upper end of the assembly 1 over the cart handle 32,34 so that the upper ends of the lateral and oppositely lateral quarter folded sections 4 and 6 directly overlie the upper surface of the handle 32,34, and so that the extreme upper end of the assembly 1 extends downwardly from the forward face of such handle. Thereafter, the golfer may engage snaps 10 and 12, 14 and 16, and 18 and 20 with each other causing the handle 32,34 to be enveloped or tubularly contained within, referring further to FIG. 6, the tubular space 46. Thereafter, referring further simultaneously to FIG. 5, the golfer may laterally align the assembly 1 so that the aperture 9 overlies socket 36. Thereafter, the golfer may screw the helically threaded lug 44 of the umbrella handle 42 into the socket 36. Referring further simultaneously to FIG. 2, upon installing the towel assembly 1 in the manner depicted in FIG. 5, and in the presence of windy weather, the folds 5 and 7 which quarter fold and tubularly configure the downwardly extending portion of the towel assembly 1 beneficially tend to retain the towel assembly 1 in the configuration of a rectangular banner for consistently and attractively displaying the logo indicia 60,62.

Upon temporary utilization of the towel assembly 1 by the golfer for hand or golf ball drying, and upon release of the assembly 1, the desired quarter folded and vertically tubular configuration quickly returns the assembly to such banner display configuration.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A towel suspension assembly for suspension from a golf push cart handle, the towel assembly comprising:

(a) an absorbent fabric sheet having an upper end, a lower end, a lateral side, an oppositely lateral side, a rearward surface, and a forward surface;

(b) a vertical fold, the vertical fold extending the absorbent fabric sheet's lateral side forwardly and oppositely laterally;

(c) a horizontal fold, the horizontal fold extending the absorbent fabric sheet's upper end in directions selected from the group consisting of forwardly and downwardly and rearwardly and downwardly;

(d) a golf push cart handle and releasable attaching means connected operatively to the fabric sheet, the releasable attachable means being adapted for, upon positioning the golf push cart handle beneath the horizontal fold, alternatively enveloping the golf push cart handle, and releasing the golf push cart handle;

(e) logo indicia;

(f) applique' means interconnecting the logo indicia and the fabric sheet, the applique' means positioning the logo indicia upon the fabric sheet's rearward surface, the applique' means further positioning the logo indicia oppositely laterally from the vertical fold; and (g) a second vertical fold, the second vertical fold extending the fabric sheet's oppositely lateral side forwardly and laterally, the applique' means further positioning the logo indicia laterally from the second vertical fold; and wherein the first and second vertical folds substantially quarter folding the absorbent fabric sheet;

(h) an umbrella handle mounting and slide stopping aperture, the umbrella handle mounting and slide stopping aperture extending through the fabric sheet and being positioned at the fabric sheet's horizontal fold;

(i) an umbrella having a handle, the handle having a lower end; and (j) a helically threaded lug and socket joint interconnecting the golf push cart handle and the umbrella handle's lower end, said joint extending through the umbrella handle mounting and slide stopping aperture.

2. The towel assembly of claim 1 wherein the releasable attaching means comprises a fastener selected from the group consisting of snaps, loop pad and flexible hook pad combinations, button and buttonhole combinations, hook and eye combinations, and magnetic fasteners.

3. The towel assembly of claim 2 wherein the logo indicia comprises an image selected from the group consisting of corporate service marks, corporate trademarks, corporate trade names, sport team names, and sport team symbols.

4. The towel assembly of claim 3 wherein the applique' means is selected from the group consisting of embroidered images, printed images, interwoven images, and thermal image transfers.

5. A towel suspension assembly comprising:

(a) a pair of tubes, each tube having inner and outer surfaces, each tube having a longitudinally extending seam, and each tube comprising absorbent fabric, a first tube among the pair of tubes, the first tube having a wall and extending substantially horizontally, the other tube among said pair being fixedly attached to or formed wholly with the first tube, said other tube extending downwardly from the first tube;

(b) a golf push cart handle and releasable attaching means connected operatively to the first tube, the releasable attaching means being adapted for, upon the receipt of the golf push cart handle, alternatively closing the first tube's longitudinally extending seam to capture the golf push cart handle, and opening said seam to release the golf push cart handle;

(c) logo indicia; and (d) applique means adapted for interconnecting the logo indicia, and said other tube; the applique means positioning the logo indicia upon said other tube's outer surface oppositely from said other tube's longitudinally extending seam;

(e) an umbrella handle mounting and slide stopping aperture extending through the first tube's wall;

(f) an umbrella having a handle, the handle having a lower end; and (g) a helically threaded lug and socket joint interconnecting the golf push cart handle and the umbrella handle's lower end, said joint extending through the umbrella mounting and slide stopping aperture.

6. The towel assembly of claim 5 wherein the releasable attaching means comprises a fastener selected from the group consisting of snaps, loop pad and flexible hook pad combinations, button and buttonhole combinations, hook and eye combinations, and magnetic fasteners.

7. The towel assembly of claim 6 wherein the logo indicia is selected from the group consisting of corporate service marks, corporate trademarks, corporate trade names, sport team names, and sport team symbols.

8. The towel assembly of claim 7 wherein the applique' means is selected from the group consisting of embroidered images, printed images, interwoven images, and thermal image transfers.

* * * * *